US006398706B1

(12) United States Patent
Huang

(10) Patent No.: US 6,398,706 B1
(45) Date of Patent: Jun. 4, 2002

(54) CENTRIFUGAL MUD SEPARATOR

(76) Inventor: Min-Yen Huang, No. 559, Kuo-Min Rd., Tainan (TW)

( * ) Notice: Subject to any disclaimer, the term of this patent is extended or adjusted under 35 U.S.C. 154(b) by 0 days.

(21) Appl. No.: 09/782,047

(22) Filed: Feb. 14, 2001

(51) Int. Cl.[7] ..... B04B 7/04; B04B 11/04

(52) U.S. Cl. ..... 494/48; 494/50; 494/60; 494/67

(58) Field of Search ..... 494/36, 43, 47, 494/48, 50, 56, 60, 67

(56) References Cited

U.S. PATENT DOCUMENTS

| | | | | | |
|---|---|---|---|---|---|
| 622,712 | A | * | 4/1899 | Rissmuller | 494/48 |
| 686,917 | A | * | 11/1901 | Baker | 494/48 |
| 1,283,846 | A | * | 11/1918 | Mark et al. | |
| 1,585,393 | A | * | 5/1926 | Laughlin | 494/67 |
| 1,640,707 | A | * | 8/1927 | Laughlin | 494/67 |
| 1,947,844 | A | * | 2/1934 | Gish | 494/48 |
| 2,233,855 | A | * | 3/1941 | Suss | 494/48 |
| 2,353,983 | A | * | 7/1944 | Banning | 494/67 |
| 2,435,665 | A | * | 2/1948 | Woolaver | |
| 3,245,613 | A | * | 4/1966 | Jonakin | |
| 3,256,993 | A | * | 6/1966 | Siepe et al. | 494/47 |
| 3,765,600 | A | * | 10/1973 | Steimel | 494/48 |
| 4,044,944 | A | * | 8/1977 | Moebus et al. | 494/48 |
| 4,085,889 | A | * | 4/1978 | Steimel | 494/48 |
| 4,347,971 | A | * | 9/1982 | Novoselac | 494/48 |
| 4,392,846 | A | * | 7/1983 | Novoselac et al. | |
| 4,468,215 | A | * | 8/1984 | Wimmer | 494/48 |
| 5,441,475 | A | * | 8/1995 | Storruste et al. | 494/48 |
| 5,484,383 | A | * | 1/1996 | Fitch, Jr. et al. | 494/67 |
| 5,788,621 | A | * | 8/1998 | Eady | |
| 5,916,084 | A | * | 6/1999 | Singleton, Jr. | |
| 6,068,587 | A | * | 5/2000 | Huang | 494/48 |

FOREIGN PATENT DOCUMENTS

| | | | |
|---|---|---|---|
| FR | 1296184 | * | 5/1962 |
| JP | 46-7872 | * | 2/1971 |
| SU | 825167 | * | 2/1971 |

* cited by examiner

*Primary Examiner*—Charles E. Cooley
(74) *Attorney, Agent, or Firm*—Dennison, Schultz & Dougherty

(57) ABSTRACT

A centrifugal mud separator includes a base frame, a lower cap, a movable disk, a vane ring, an upper cap, a converging impeller, a soil retention speed reducer and a soil scraping means. Through high speed rotation, a centrifugal force and a stepless rotation speed difference will be generated in the mud that has been fed into the separator to result in the carried object (soil carried by water) suspended outwardly from low speed to high speed thereby to separate soil from water rapidly. By setting different speed variation to control speed difference between the soil and the vanes, the soil will hit the vanes at different times and result in different remaining water content in the soil according to desired specifications until reaching synchronous speed with the vanes. The soil will be spun and collected by the soil retention speed reducer. Water separated from the mud will be sucked into the impeller and discharged out through a water discharge pipe. Soil and water in the mud may be separated rapidly under a controlled condition in a simpler process to save hardware space and operate at high speed under desired specifications.

1 Claim, 11 Drawing Sheets

CENTRIFUGAL MUD SEPARATOR

BACKGROUND OF THE INVENTION

This invention relates to a centrifugal mud separator and particularly a mud separator that employs high speed rotation upper and lower cap to generate centrifugal force and suspension effect resulting from liquid speed differentiation and continuous impact against guiding vanes for separating soil and water from the mud.

Conventional centrifugal mud separators are generally constructed like the one disclosed in ROC New Utility Patent No. 87201743 on Mar. 11, 1999, shown in FIG. 1. It generally includes a base frame 10 which supports a motor 11 to drive a separation barrel 12 to rotate. Mud dropped into the barrel 12 is driven by a spindle 13 and blades 14 to splash on the inside surface of the barrel 12. The rotating barrel 12 generates centrifugal force to separate soil from the water. Due to centrifugal force, the soil residue which has greater specific gravity is moved upward to push the upper cap 15 upward to form a gap with the barrel 12. The soil residue then will be discharged out through the gap into a trough 16 located on the base frame 10 and be carried away by a conveyer 18 through the plate 17. The water being separated drops downward in the barrel 12 and is discharged out through an outlet 19 located at a lower portion of the barrel 12. The whole separation process is done automatically. It may save a lot of manpower and process time for clearing the soil residue, and thus increases economic value. However this type of separator cannot adjust mud throwing power and remainder water content, and results in not total separation of soil and water. There is still room for improvement.

SUMMARY OF THE INVENTION

It is therefore an object of this invention to provide an improved centrifugal mud separator that has a changeable speed setting to separate soil and water automatically, and adjustable soil squeezing force to control the movement of a movable disk for opening discharging outlets and water content in the discharged soil thereby to simplify operation, save hardware space, run continuously at high speed and conform with specified process desired.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

This invention aims at providing a centrifugal mud separator that has a changeable speed setting to separate soil and water automatically, and adjustable soil squeezing force to control the movement of a movable disk for opening discharging outlets and water content in the discharged soil thereby to simplify operation, save hardware space, run continuously at high speed and conform with specified process desired.

Figure 1:
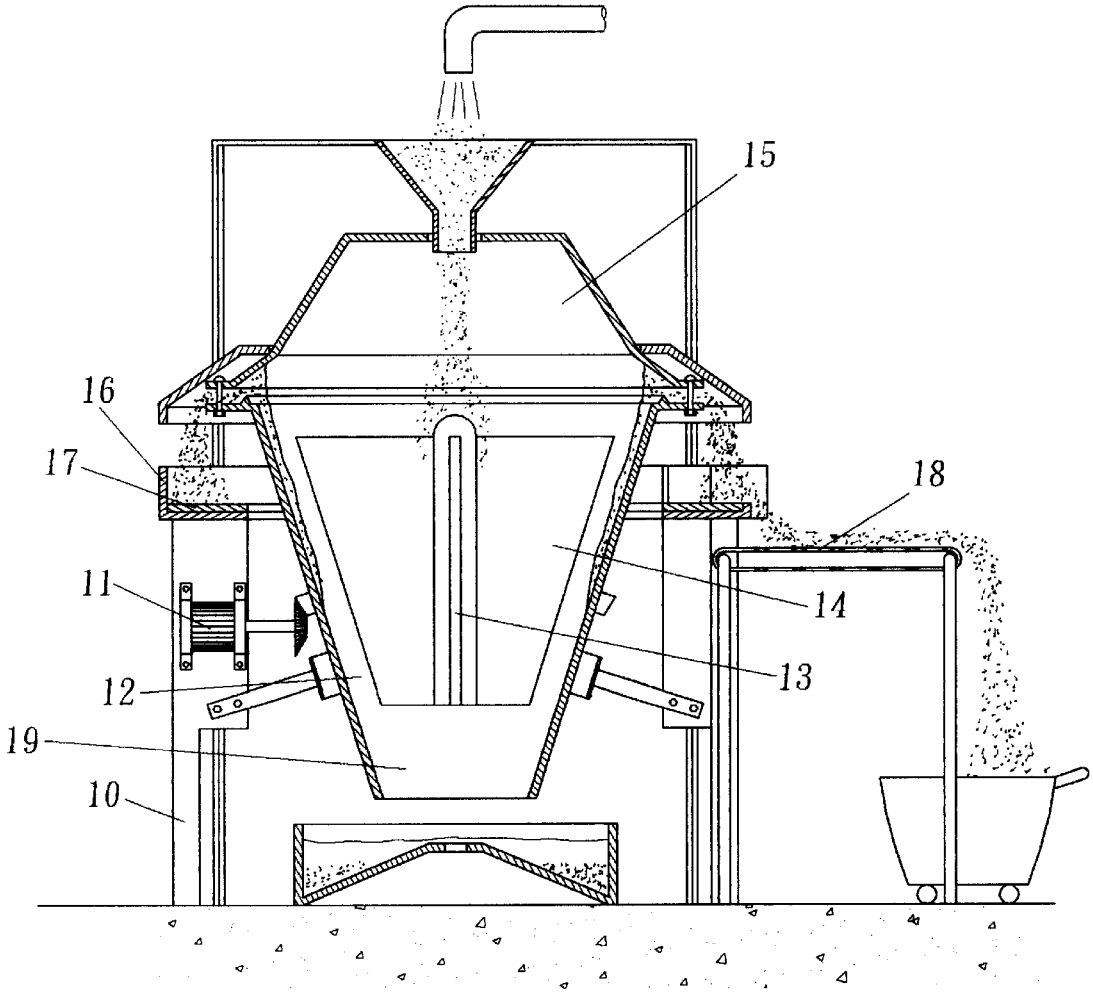
F I G . 1 PRIOR ART
FIG. 1 is a schematic view of a conventional mud separator.
Figure 2:
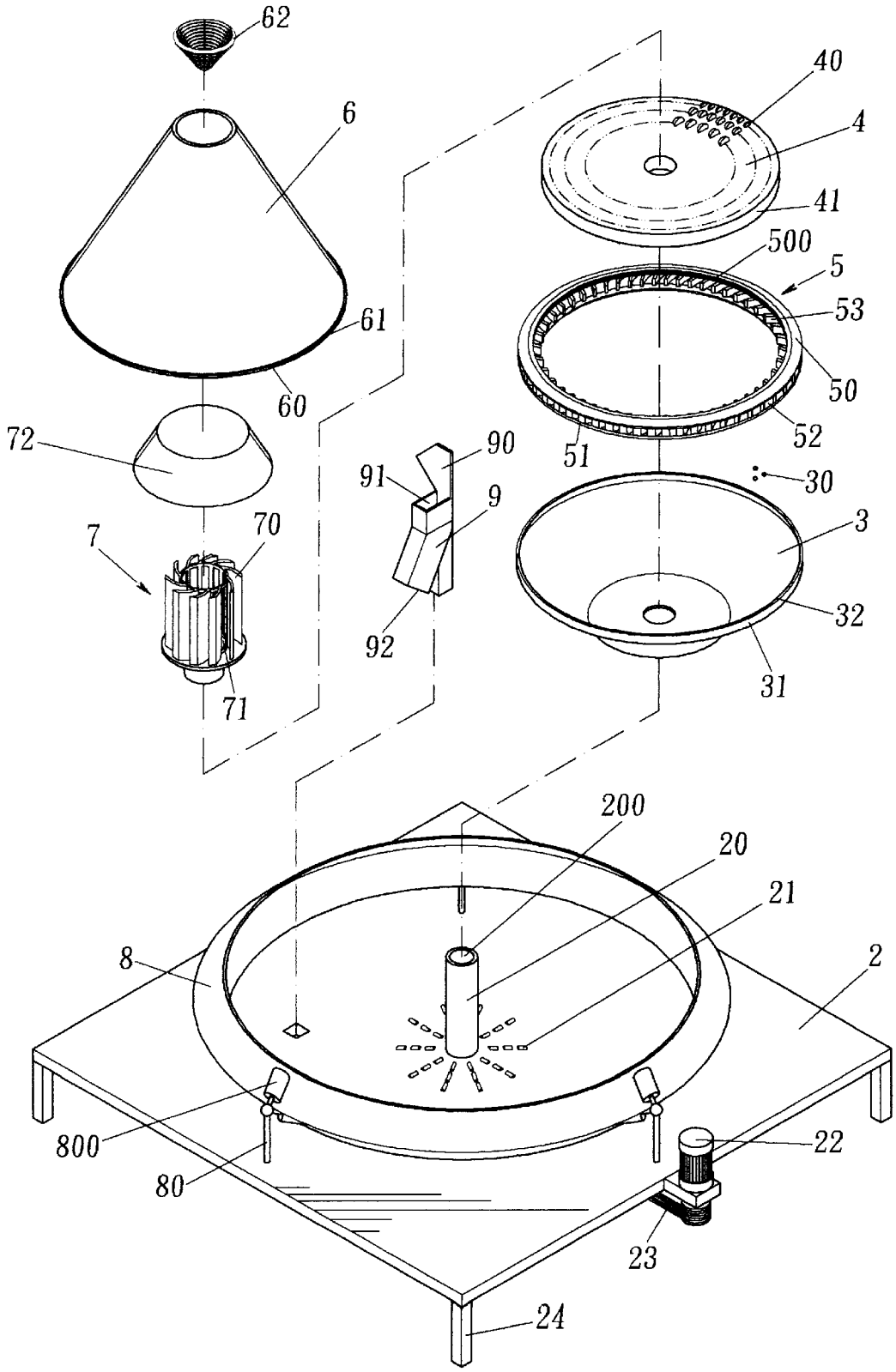
FIG. 2 is an exploded view of this invention.
Figure 3:
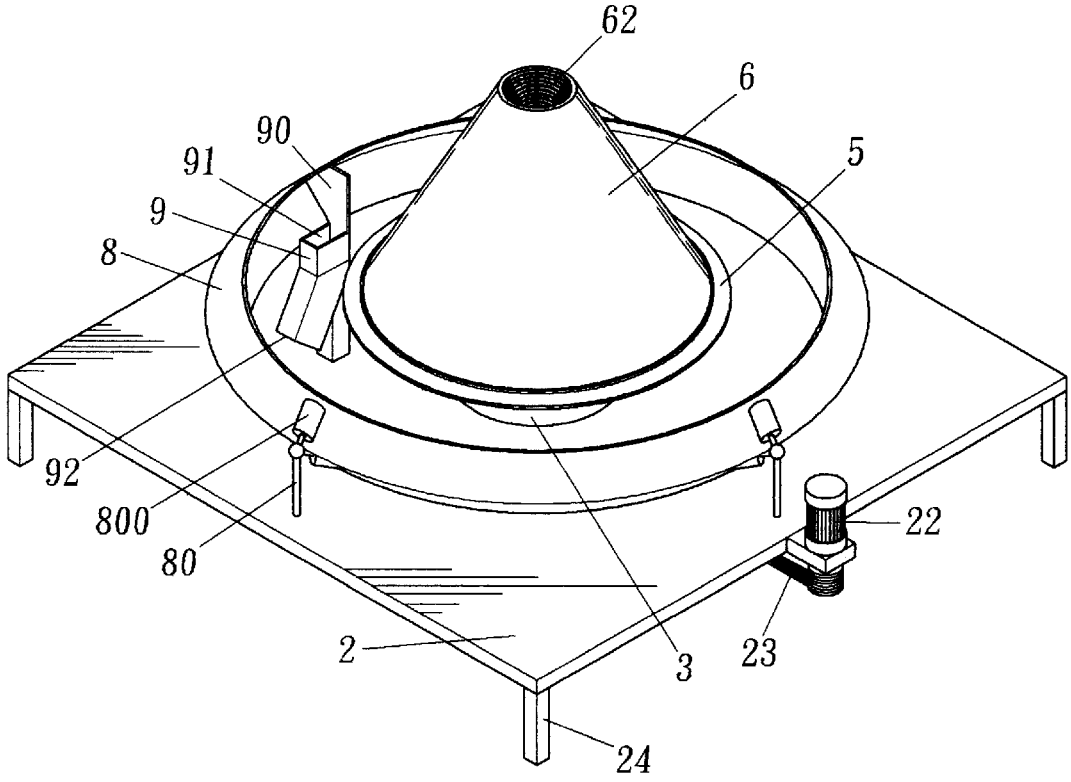
FIG. 3 is a perspective of this invention.

Referring to FIGS. 2 and 3, the separator according to this invention includes primarily a base frame 2, a lower cap 3, a movable disk 4, a vane ring 5, an upper cap 6, a converging impeller 7, a soil retention speed reducer 8 and a soil scraping means 9. The base frame 2 has a hollow spindle 20 which forms a discharge pipe 200 inside and a plurality of roller bearings 21 surrounding the spindle 20 in an annular fashion. At one edge of the base frame 2, there is a motor 22 engaged with a plurality of belts 23 for driving the spindle 20. The base frame 2 is supported by shock absorbers 24 at the bottom thereof.

Figure 4:
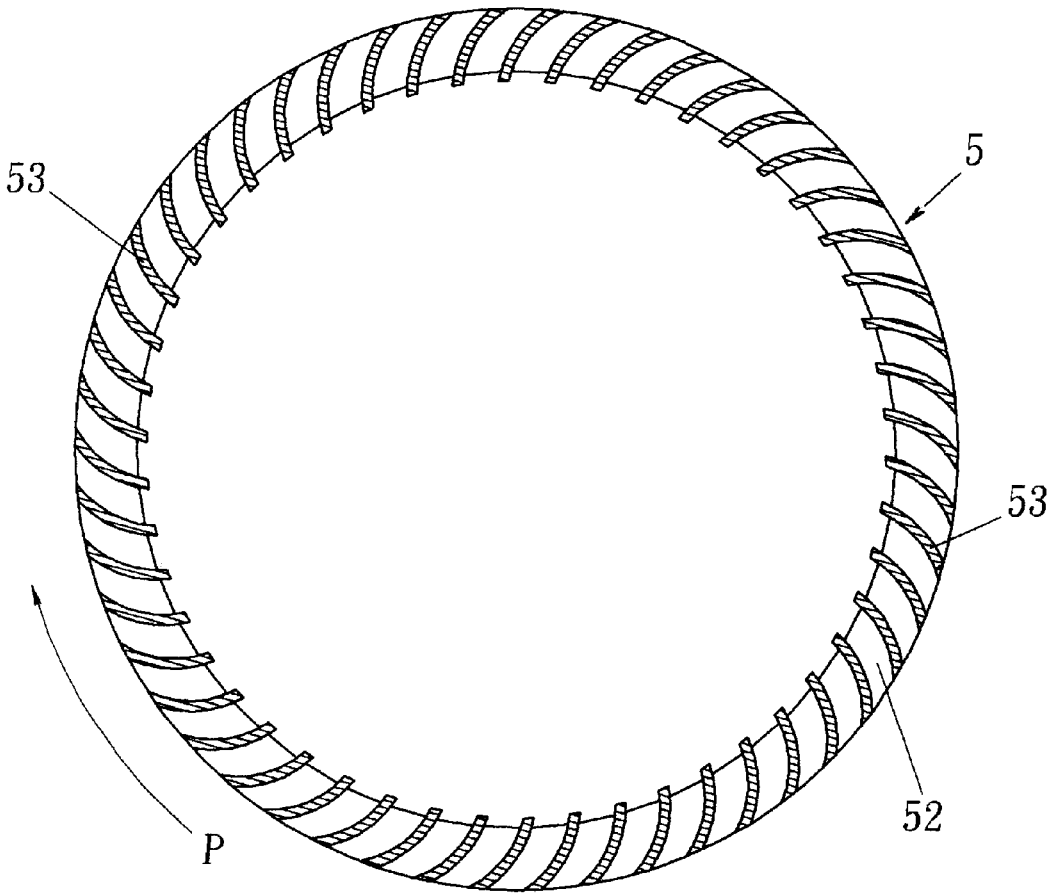
FIG. 4 is a schematic top view of a vane ring of this invention.
Figure 5:
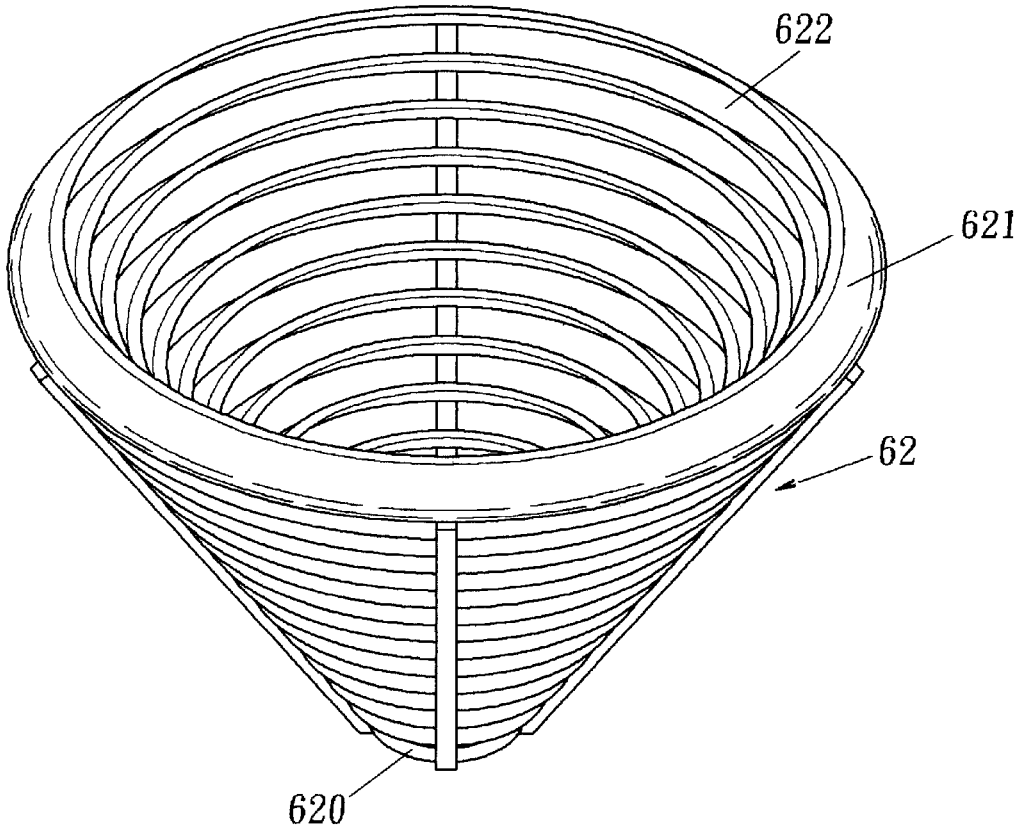
FIG. 5 is a perspective view of a flow guide of this invention.
Figure 6:
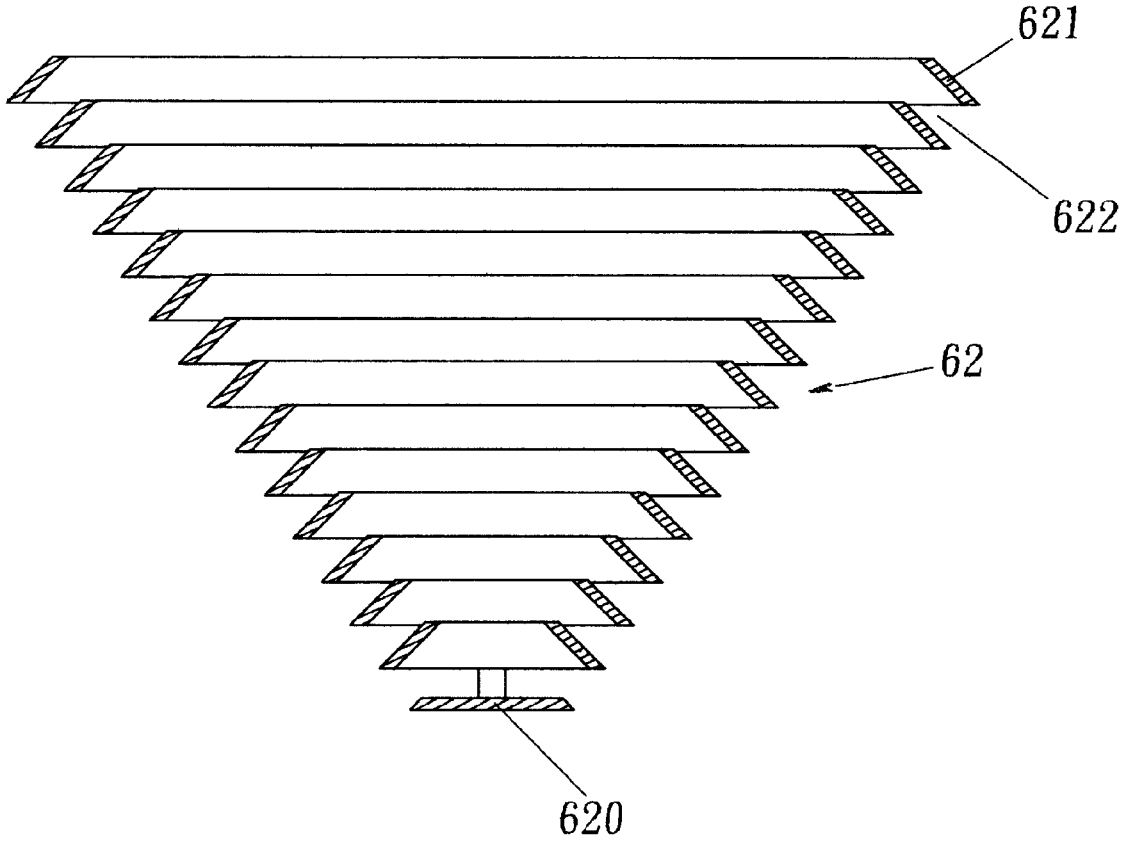
FIG. 6 is a sectional view of a flow guide of this invention.
Figure 7:
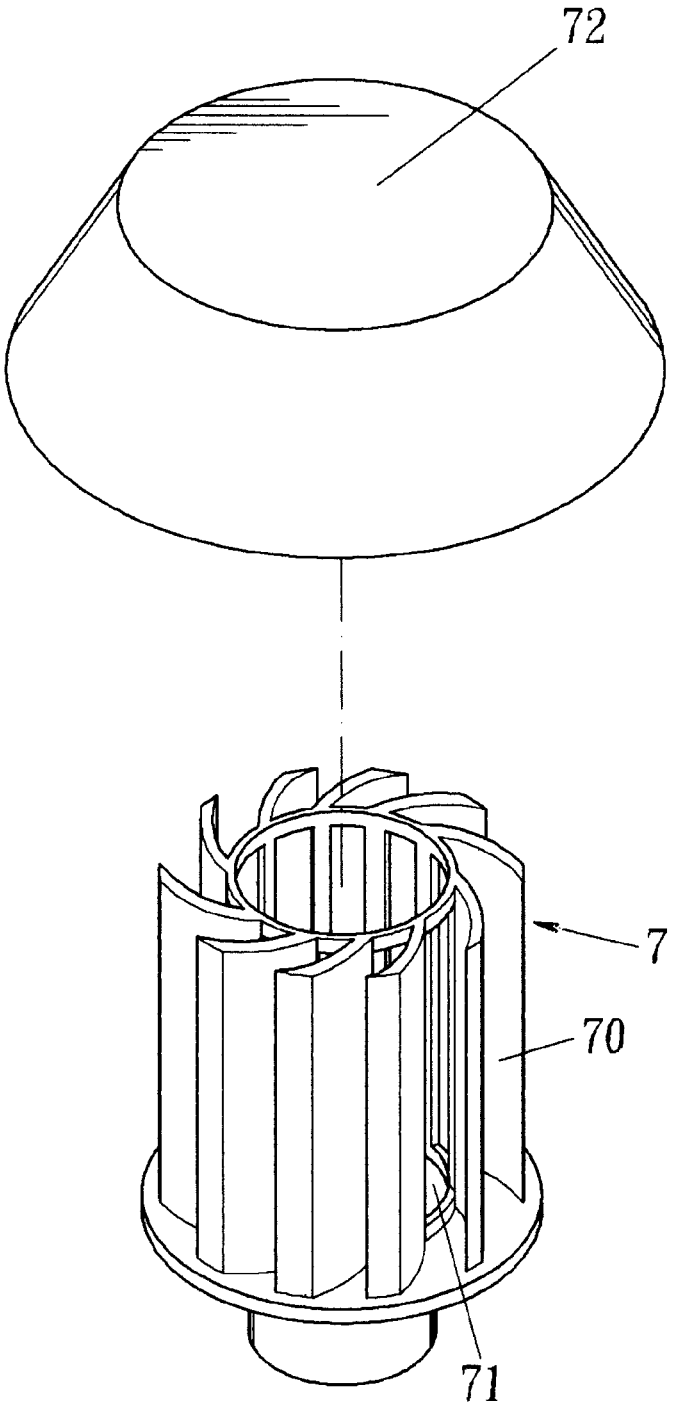
FIG. 7 is a perspective view of an impeller of this invention.
Figure 8:
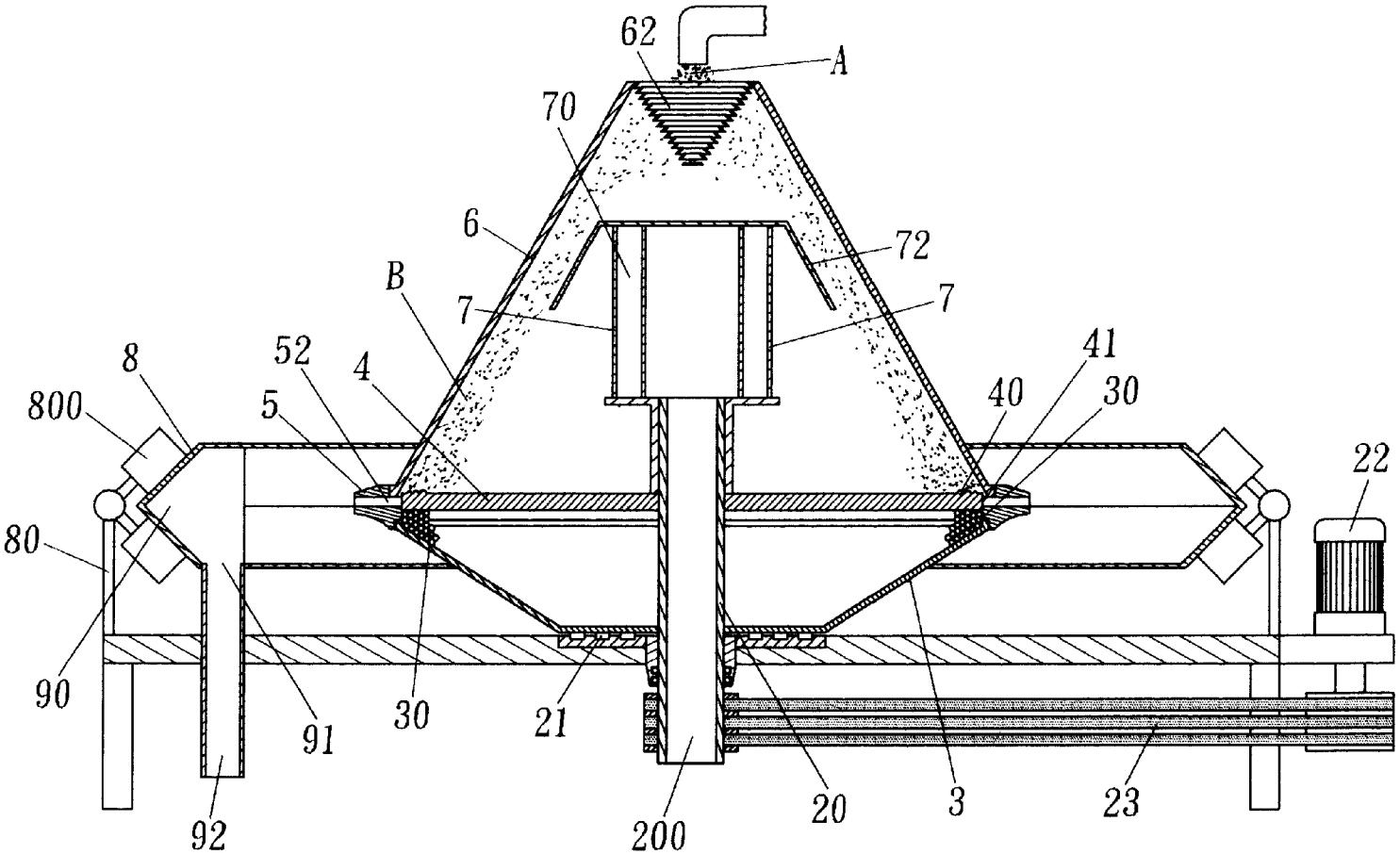
FIG. 8 is a schematic view of this invention in use, with the movable disk closing the vane ring outlets.

The lower cap 3 engages with a lower portion of the spindle 20 and has a flat bottom mounted on the base frame 2 and is turnable on the roller bearings 21. Inside the lower cap 3, a plurality of steel balls 30 are provided (also shown in FIG. 8). The steel balls 30 are covered with lubricant oil for sticking to the top rim of the lower cap 3. The lubricant oil also has a lubrication and heat dissipating effect. The lower cap 3 has a top rim which forms a first fastening section 31 at the outer circumference thereof (also shown in FIG. 9). The first fastening section 31 has screw threads 32. The movable disk 4 is located above the lower cap 3 and movably surrounding the spindle 20 and is made of a light weight material (or a hollow member). The movable disk 4 has three concentric circular bulged rings 40 of different diameters formed at the upper surface adjacent the outer perimeter. The bulged rings 40 have increasing thickness from the outer side toward the inner side. The movable disk 4 also has an outer rim 41 of a selected thickness. The vane ring 5 has a lower fastening section 51 which has lower screw threads 510 for engaging with the first fastening section 31, an upper fastening section 50 which has upper screw threads 500 and a plurality of arched vanes 53 with a vane outlet 52 formed between each pair of adjacent vanes 53 (shown in FIG. 4). The vanes 53 are disposed in an anti-centrifugal manner against the rotation direction P. When the lower cap 3 rotates, the steel balls 30 will be moved outwardly and upwardly due centrifugal force and push the movable disk 4 upward thereby the outer rim 41 will block the vane outlets 52 (also shown in FIG. 9). The upper cap 6 is located above the vane ring 5 and is formed in a shape of a reverse cone and has a bottom rim forming a second fastening section 60 which has screw threads 61 for engaging with the upper fastening section 50 of the vane ring 5. At the upper portion of the upper cap 6, there is a flow guide 62 (also shown in FIGS. 5 and 6) which has a stopper 620 in the center and a plurality of inclined flow vanes 621 stacked and spaced from one another in step wise fashion with increasing diameters from the stopper 620. The space formed between each adjacent pair of flow vanes 621 becomes a sifting slot 622 which has an interval distance smaller than one half of the vane outlet 52. Inside the upper cap 6 and below the flow guide 62, there is a converging impeller 7 fixedly mounted on the top end of the spindle 20 (FIGS. 7 and 8). The converging impeller 7 is hollow in the center and has a plurality of blades 70 annularly surrounding the center thereof. Each pair of adjacent blades 70 form a slot 71 therebetween. The impeller 7 further has a shield cap 72 at the top end. The slots 71 and hollow center of the impeller 7 are fluidly communicating with the hollow spindle 20 and water discharge pipe 200. The soil retention speed reducer 8 is an annular member having a <-shaped side wall surrounding and spaced from the circumferences of the upper and lower cap 6 and 3. The soil retention speed reducer 8 is supported by a plurality of posts 80 each has two rollers 800 to hold the side wall of the soil retention speed reducer 8 such that the soil retention speed reducer 8 may rotate freely between the posts 80. There is a soil scraping means 9 located inside the soil retention speed reducer 8. The soil scraping means 9 includes a flat scraper 90 contacting the inside wall of the soil retention speed reducer 8, an inlet 91 located below the flat scraper 90 and an outlet 92 located at one side of the soil scraping means 9 communicating with the inlet 91.

Figure 9:
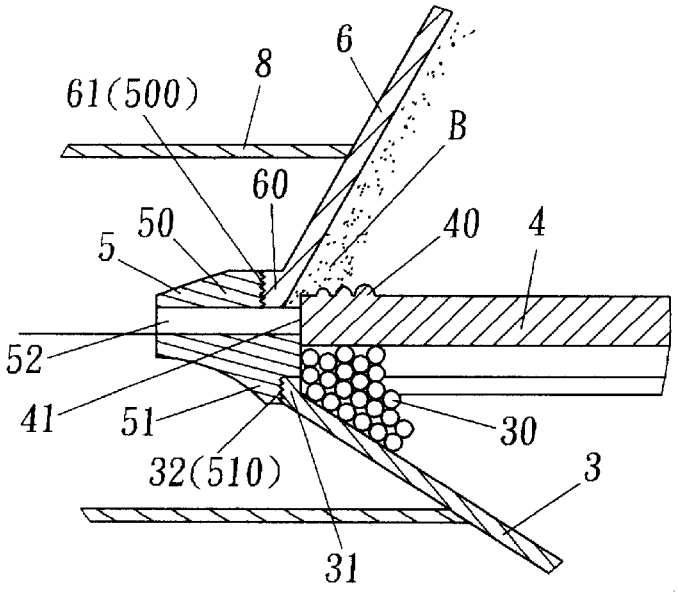
FIG. 9 is an enlarged fragmentary sectional view of the movable disk and vane ring shown in FIG. 8
Figure 11:
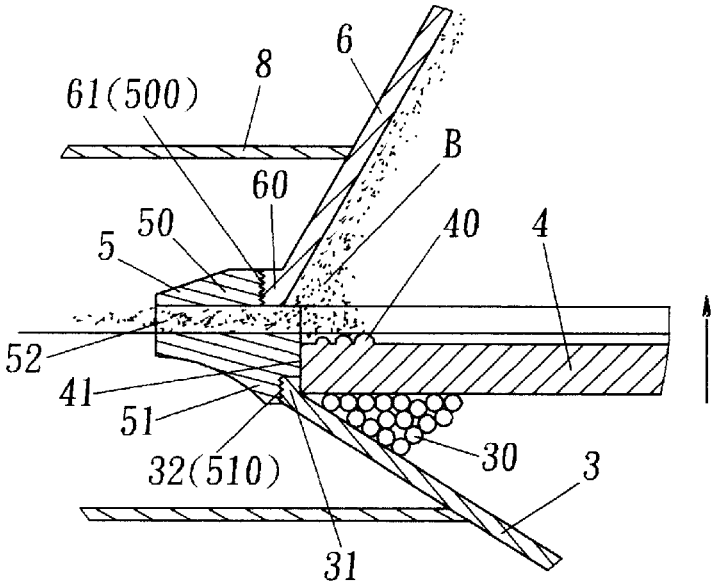
FIG. 11 is an enlarged fragmentary sectional view of the movable disk and vane ring shown in FIG. 10.
Figure 10:
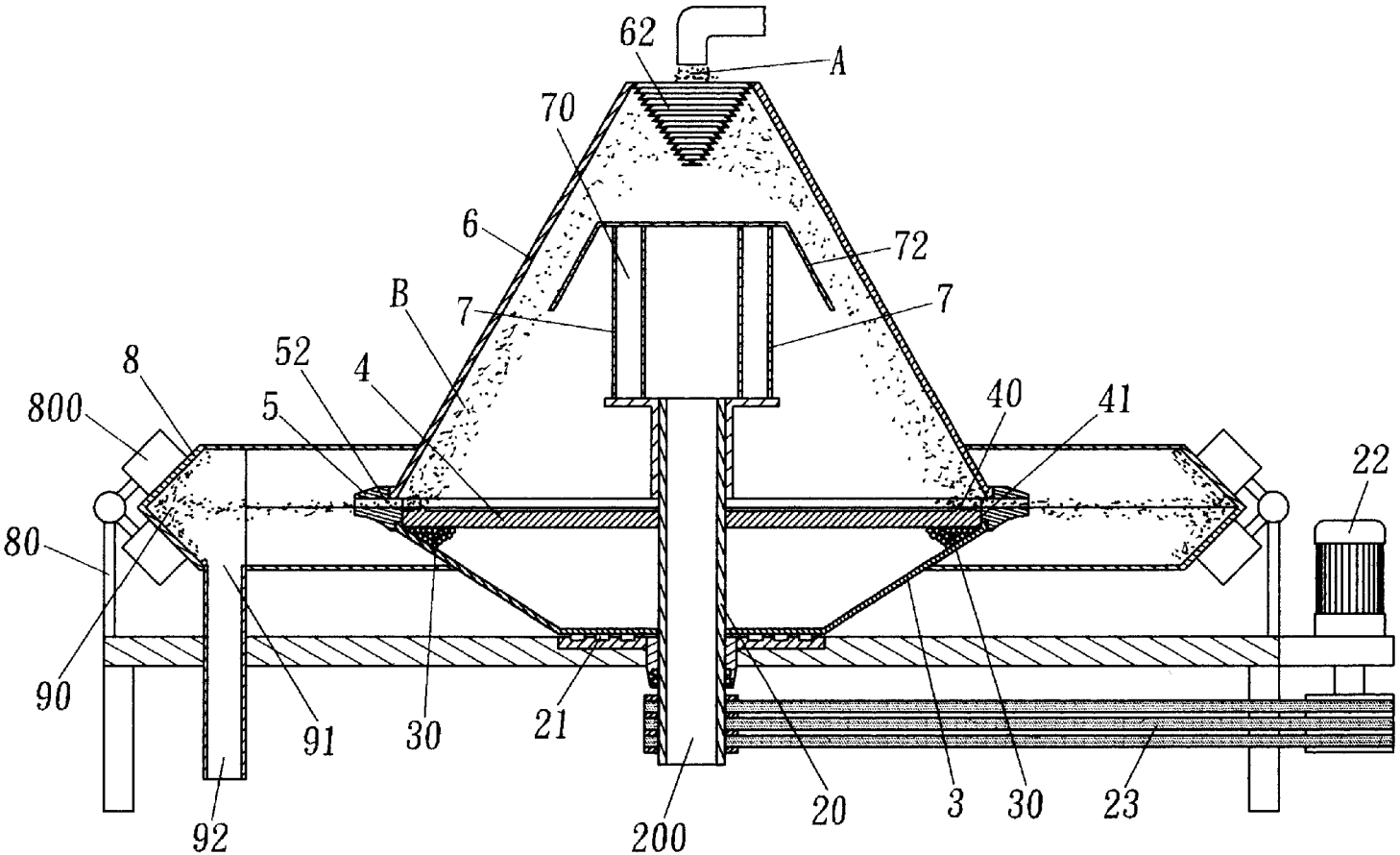
FIG. 10 is a schematic view of this invention in use, with the movable disk opening the vane ring outlet.
Figure 12:
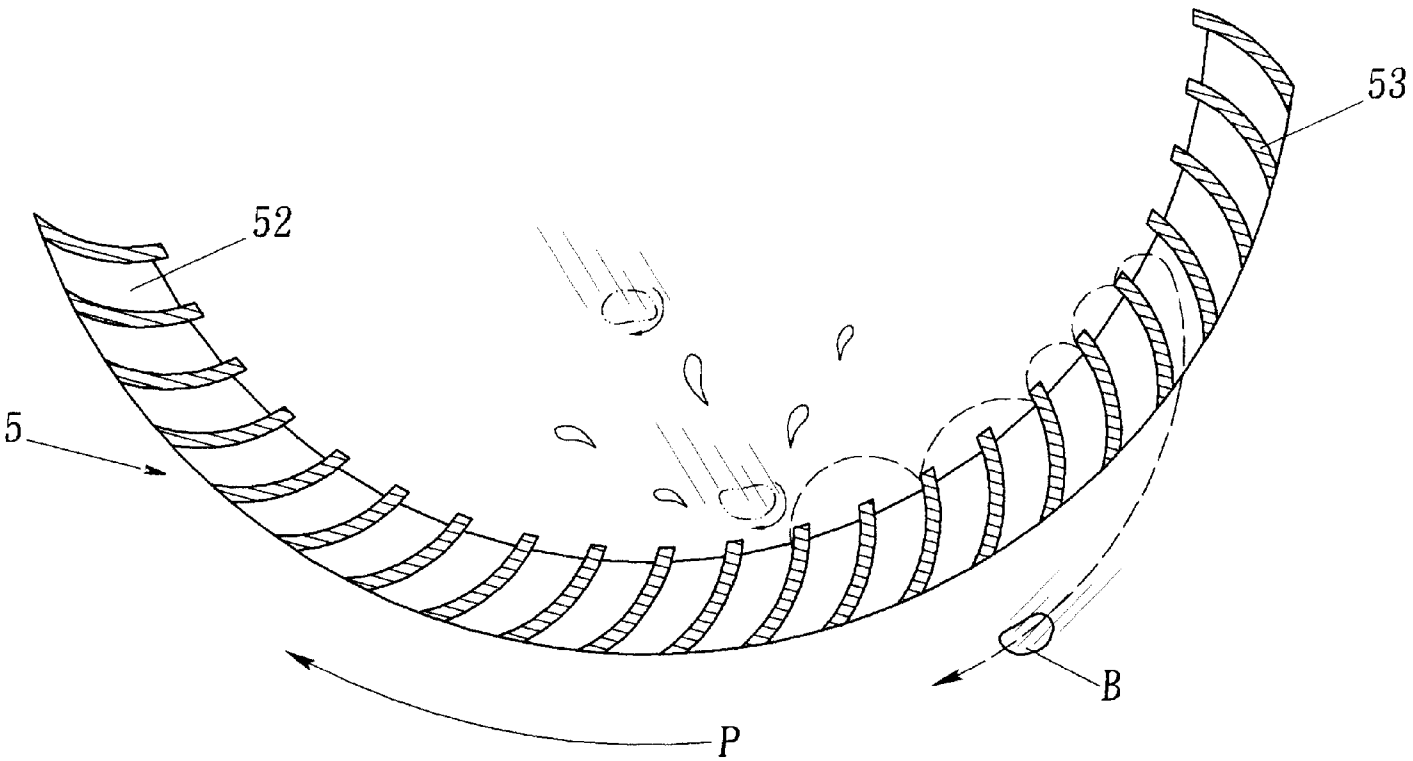
FIG. 12 is a fragmentary schematic view of this invention in use, with soil hitting the vane ring.

Referring to FIGS. 8 and 9, when this invention is in use, the motor 22 rotates at a high speed to drive the belts 23 which in turn rotates the spindle 20. The lower and upper cap 3 and 6 are turned synchronously through the vane ring 5. Because the lower cap 3 is supported by the roller bearings 21, it may be rotated at high speed with a lower friction. Under high speed rotation and the centrifugal force incurred, the steel balls 30 will generate a balance force and move upwardly to press against the movable disk 4. The disk rim 41 hence may move upward to close the vane outlets 52 of the vane ring 5. When mud A is fed into the separator from the top end of the upper cap 6, the mud drops down into the flow guide 62, flows along the flow vanes 621 and through the sifting slots 622. Large size articles or gravel which cannot pass through the sifting slots 622 will be lifted along the flow vanes 621 and thrown away outside the flow guide 62 because of the centrifugal force. The articles or gravel which have smaller sizes than the sifting slot 622 will pass through the sifting slots 622. Hence only soil residue less than the size of the vane outlet 52 will be allowed to enter into the upper cap 6 for further process. The entering mud A then will drop onto the rotating shield cap 72 of the impeller 7 and be splashed, and slides and drops on the movable disk 4. The mud then will be drawn by the high speed rotating bulged rings 40 and dispersed and pressed in an outward direction. As the inside rotation speed of the upper cap 6 increases from the center to the outer periphery, there is a relative speed difference between the mud A initially sticking to the inside surface of the upper cap 6 and those located at the outer rim (vanes 53). As a result, a couple will be generated and produces a torsion. The mud A located at the center will generate self rotation and be spun toward the outer rim of the upper cap 6. Adapted with the centrifugal force, the soil B which has a greater specific gravity will be separated and moved toward the disk rim 41 at the closed vane outlets 52. When the soil B accumulates to a selected amount and produces a downward force greater than the upward pressure exerting from the steel balls 30, the movable disk 4 will be pressed downward. The disk rim 41 will be moved away from the vane outlets 52 (shown in FIGS. 10 and 11). Since the speed of the soil B is not yet synchronous with the rotation speed of the vanes 53, the soil B will hit the first vane 53 and bounce because of relative speed 20 difference (shown in FIG. 12), then will hit the subsequent vanes 53 in succession and accumulate kinetic energy. Because of the continuous self rotation and hitting, water in the soil B will be separated due to inertia force and be collected at the center portion of the upper cap 6 until the speed of the soil B coincides with the vanes 53. Then the soil B will be spun out along a tangent direction at high speed through the vane outlets 52 due to its own centrifugal force. The spun soil B will hit and stick to the inside wall of the soil retention speed reducer 8 and drive the soil retention speed reducer 8 rotating upon the rollers 800. When the turning soil retention speed reducer 8 reaches the scraping means 9, the soil B stuck to the inside wall of the soil retention speed reducer 8 will be removed by the flat scraper 90 and drops into the inlet 91 and be discharged through the outlet 92 which leads to a soil residue collection or disposal means (not shown in the figures).

When the soil B has been spun out from the upper cap 6 for a selected amount such that the downward force resulting from the weight of the remaining soil B on the disk 4 is less than the upward force exerting from the steel balls 30, the disk 4 will be moved upward to enable the outer rim 41 to close the vane outlets 52. The water being separated and collected at the center portion is spinning at a greater radius than the impeller 7, and will be sucked into the spindle 20 through the slots 71 because of suction force resulting from high speed rotation of the impeller 7. The water flowed into the spindle 20 then will be discharged out through the water discharge pipe 200. By means of the foregoing construction and operation, soil B and water in the mud may be separated efficiently. The discharged water may also carry away the heat generated in the spindle 20 during high speed rotation for cooling the separator effectively.

The rotation speed of this invention may be set at different levels. When the initial rotation speed of the soil B is not up to the level of the vanes 53, the soil B will hit the vanes 53 continuously to separate water from the soil B. The soil B will become dryer and rotate faster. Hence by setting different rotation speed, different degree of remaining water content in the soil B may be obtained as desired.

In summary, this invention offers the following advantages:

1. It is a fully automatic separating operation that may separate soil and water effectively, rapidly and continuously, and save hardware space.
2. Through the sifting function of the flow guide, the sizes of soil will be separated and controlled as desired without blocking the vane outlets.
3. Through controlling the rotation speed variation, water being separated from the soil and remaining water content in the soil may be controlled at a desired degree to reach required operation specifications.

It may thus be seen that the objects of the invention set forth herein, as well as those made apparent from the foregoing description, are efficiently attained. While the preferred embodiment of the invention has been set forth for purpose of disclosure, it would be obvious to those skilled in the art that various other changes and modifications can be made without departing from the spirit and scope of the invention.

What is claimed is:

1. A centrifugal mud separator, comprising:

a base frame including a hollow spindle served as a water discharge pipe, a plurality of roller bearings surrounding the spindle annularly, a motor located at an outer edge of the base frame and a plurality of belts engaging with the motor and spindle;

a lower cap engaged with a lower portion of the spindle having a selected number of steel balls located inside which are covered with lubricant oil for sticking to a top rim of the lower cap, and a first fastening section formed at the circumference of the top rim thereof, the first fastening section having screw threads formed thereon;

a movable disk movably mounted on the spindle having a plurality of concentric circular bulged rings formed at the outer periphery and a circumferential disk rim of a selected thickness;

a vane ring located above the lower cap having a lower fastening section which has screw threads engaged with the first fastening section, an upper fastening section which has screw threads, and a plurality of vane outlets formed at the outer perimeter thereof, each vane outlet being bordered by two vanes at two sides thereof;

an upper cap located above the vane ring having a second fastening section which has screw threads engaged with the upper fastening section and a flow guide located at an upper portion thereof, the flow guide having a stopper at a center thereof and a plurality of stepwise and inclined flow vanes located above the stopper, each pair of adjacent flow vanes forming a sifting slot therebetween;

a converging impeller mounted at the top end of the spindle having a hollow center, a plurality of blades surrounding the hollow center and forming a slot between each pair of the blades, and a shield cap located at the top end thereof;

a soil retention speed reducer surrounding the circumferences of the upper and lower cap and supported by a plurality of posts, each post having a plurality of rollers; and a soil scraping means located inside the soil retention speed reducer having a flat scraper at an upper portion thereof, an inlet located below the flat scraper and an outlet located at one side of the soil scraping means communicating with the inlet.

* * * * *